US010796896B2

(12) United States Patent
Böhm

(10) Patent No.: US 10,796,896 B2
(45) Date of Patent: Oct. 6, 2020

(54) DESORPTION BEAM CONTROL WITH VIRTUAL AXIS TRACKING IN TIME-OF-FLIGHT MASS SPECTROMETERS

(71) Applicant: Bruker Daltonik GmbH, Bremen (DE)

(72) Inventor: Sebastian Böhm, Bremen (DE)

( * ) Notice: Subject to any disclaimer, the term of this patent is extended or adjusted under 35 U.S.C. 154(b) by 0 days.

(21) Appl. No.: 16/422,821

(22) Filed: May 24, 2019

(65) Prior Publication Data

US 2019/0362958 A1 Nov. 28, 2019

(30) Foreign Application Priority Data

May 25, 2018 (DE) ..... 10 2018 112 538

(51) Int. Cl.
*H01J 49/00* (2006.01)
*H01J 49/40* (2006.01)
*H01J 49/16* (2006.01)

(52) U.S. Cl.
CPC ..... *H01J 49/403* (2013.01); *H01J 49/0004* (2013.01); *H01J 49/164* (2013.01)

(58) Field of Classification Search
CPC .... H01J 49/00; H01J 49/0027; H01J 49/0031; H01J 49/02; H01J 49/0418; H01J 49/0413; H01J 49/0459; H01J 49/0463; H01J 49/16; H01J 49/161; H01J 49/164; H01J 49/40; H01J 49/403
USPC ..... 250/281, 282, 287, 288
See application file for complete search history.

(56) References Cited

U.S. PATENT DOCUMENTS

| | | | |
|---|---|---|---|
| 7,667,196 | B2 | 2/2010 | Schürenberg et al. |
| 7,872,223 | B2 | 1/2011 | Yamaguchi |
| 8,237,113 | B2 | 8/2012 | Schürenberg |
| 8,605,968 | B2 | 12/2013 | Alexandrov |
| 8,872,103 | B2 | 10/2014 | Holle et al. |
| 10,197,576 | B2 | 2/2019 | Suckau et al. |

(Continued)

FOREIGN PATENT DOCUMENTS

| | | | |
|---|---|---|---|
| DE | 102006019530 | A1 | 11/2007 |
| DE | 102006059695 | B3 | 7/2008 |

(Continued)

*Primary Examiner* — Jason L McCormack
(74) *Attorney, Agent, or Firm* — Benoit & Côté Inc.

(57) ABSTRACT

The invention relates to time-of-flight mass spectrometers with pulsed ionization of samples, for example by matrix-assisted laser desorption (MALDI), where the samples are located on a sample support and are irradiated and ionized one after the other in a grid by a position-controlled desorption beam. An ion-optical puller lens arrangement is positioned in front of the sample support, with at least one of the lens diaphragms in the arrangement being subdivided into segments, and a voltage supply being able to supply the segments, or some of them, with different voltages, depending on the impact position of the desorption beam on the support plate. It is then possible to virtually shift the effective ion-optical focusing center of the lens away from the axis, and to focus an ion beam, which is generated off the real lens axis, into a beam which runs essentially parallel to the real lens axis, with no time phase shift for ions of the same mass. This beam can be brought back onto the axis by an x/y deflection unit, for example for operating the time-of-flight mass spectrometer with a reflector.

10 Claims, 4 Drawing Sheets

(56) References Cited

U.S. PATENT DOCUMENTS

| | | | | |
|---|---|---|---|---|
| 2005/0127289 | A1* | 6/2005 | Fuhrer | H01J 49/0059 250/288 |
| 2005/0161597 | A1* | 7/2005 | Guevremont | H01J 49/0413 250/294 |
| 2009/0289184 | A1 | 11/2009 | Deininger et al. | |

FOREIGN PATENT DOCUMENTS

| | | | |
|---|---|---|---|
| DE | 102008023438 | A1 | 12/2009 |
| DE | 102010009853 | A1 | 9/2011 |
| DE | 102010051810 | A1 | 5/2012 |
| DE | 102011112649 | A1 | 3/2013 |
| GB | 2551060 | A | 6/2017 |
| WO | 2007116509 | A1 | 10/2007 |

* cited by examiner

DESORPTION BEAM CONTROL WITH VIRTUAL AXIS TRACKING IN TIME-OF-FLIGHT MASS SPECTROMETERS

BACKGROUND OF THE INVENTION

Field of the Invention

The invention relates to time-of-flight mass spectrometers with pulsed ionization of samples which are located on a support, where a multitude of separate samples or a multitude of sites on a spatially extended sample are irradiated and ionized one after the other in a grid, for example by a pulsed laser with position-controlled laser focus for matrix-assisted laser desorption (MALDI) or by a position-controlled primary ion beam for secondary ion mass spectrometry (SIMS).

Description of the Related Art

The Prior Art is explained below with reference to a special aspect, in particular MALDI time-of-flight mass spectrometry. This should not be understood as a limitation, however. Useful further developments and modifications of what is known from the Prior Art can also be used above and beyond the comparatively narrow scope of this introduction, and will easily be evident to the expert skilled in the art in this field after reading the following disclosure.

The patent specification DE 10 2011 112 649 B4 ("Laserspotsteuerung in MALDI-Massenspektrometern"; A. Holle et al.; corresponding to GB 2 495 805 B and U.S. Pat. No. 8,872,103 B2) explains how the position of a laser spot in a MALDI mass spectrometer can be controlled between two spectral acquisitions such that a spatially extended sample, for example a tissue sample, can be scanned in the form of a grid to generate a mass spectrometric image of the sample. The positioning is undertaken in 100 microseconds, and thus allows an acquisition rate of $10^4$ mass spectra per second. The mass spectrometric image corresponds to a color image, where each point of the image (each pixel) contains a full mass spectrum instead of a color spectrum.

The patent specification DE 10 2011 112 649 B4 and all its content is to be included here by reference. The Prior Art up to the introduction of the laser spot control is also described in detail in this patent specification.

Laser spot control has given imaging mass spectrometry a boost. It is undertaken in conjunction with a linearly uniform movement of the sample support in order to scan large tissue surfaces of up to a square centimeter and more. But high-throughput mass spectrometry with many hundreds or even many thousands of samples on a sample support also benefits from laser spot control.

Unfortunately, the movement of the sample support, which is usually generated by a stepper motor, is never completely uniform and is often disturbed by oscillation processes, too. It can therefore be advantageous to carry out the acquisition of mass spectra using a sample support which is stationary and steady. But with a stationary sample support, the laser spot control can only scan a square measuring 100 micrometers by 100 micrometers at most, since ions of the same mass are no longer accelerated in phase by the puller lens if the ion beam passes through the puller lens at a distance of more than 50 micrometers off the lens axis, which corresponds to the flight path of the axis of flight at this location. Ions of the same mass no longer fly in phase because of the phase shift, and therefore they arrive at the detector at slightly different times, with the consequence that the mass resolution is restricted.

The ions in the ion source are accelerated to different velocities because of their different masses. Lighter ions arrive at the ion detector earlier than heavier ones. At the ion detector, the ion currents are measured and digitized with two to eight measurements per nanosecond. The times of flight of the ions are determined from the measurements, and the masses of the ions from the times of flight. As the person skilled in the art is aware, velocity-focusing reflectors can be utilized to increase the resolution. In particular, a delayed acceleration of the ions (DE=delayed extraction) can additionally refocus ions of the same mass effectively despite the initially broad distribution of their initial energies brought about by the expanding plasma cloud. It corresponds to the State of the Art to add together around 30 to 1,000 individual time-of-flight spectra of one sample to form a sum time-of-flight spectrum and obtain the mass spectrum of the sample from it. Mass resolutions of $R=m/\Delta m>50\,000$ are currently achieved with good time-of-flight mass spectrometers, in a wide mass range of $1000\ \text{Da}<m/z<4000\ \text{Da}$. The mass accuracies nowadays reach values in the order of a millionth of the mass (1 ppm).

Over the years, the laser technology for MALDI time-of-flight mass spectrometers has improved enormously. Not only has the splitting of the laser spot into several intensity peaks been introduced and used widely under the name "smartbeam", but the laser shot frequency has also been increased from initially 20 shots per second with UV nitrogen lasers to today's 10,000 shots per second using UV solid state lasers, which means that only 100 microseconds are available for the acquisition of a time-of-flight spectrum, and for changes to the position of the laser spot, also. With five measurements of the ion current at the detector per nanosecond, a single time-of-flight spectrum then consists of 500,000 measurements. As already mentioned, 30 to 1,000 individual time-of-flight spectra are acquired from one sample, which are added together, measurement by measurement, to form a sum time-of-flight spectrum. The mass spectrum of the sample is then obtained from this.

A special application of this technique with high laser shot rates is to be found in "imaging mass spectrometry" of thin tissue sections, which is used to acquire up to hundreds of thousands of mass spectra from a thin tissue section. Just as an original color image contains a full color spectrum in each pixel, a mass spectrometric image contains a full mass spectrum in every pixel. Nowadays, pixel separations from 50 down to 20 micrometers are used, and the aim for the future is separations of 10 or even 5 micrometers. From a square centimeter of thin tissue section, 40,000 mass spectra are obtained at a resolution of 50 micrometers, while at 10-micrometer resolution it is already one million mass spectra. Here also, the mass spectrum of one pixel is generally obtained by adding together the individual time-of-flight spectra from 30 to 1,000 laser shots to form a sum time-of-flight spectrum, from which the mass spectrum of the pixel is then obtained. The larger the number of individual time-of-flight spectra which are added together in each case, the better the detection limit and signal-to-noise ratio become. It is not always possible, however, to acquire and add together arbitrarily large numbers of individual time-of-flight spectra from the same spot, since the sample is usually quickly exhausted.

Moreover, the aim today is also to achieve a uniform utilization of the available area of a sample site and thus to utilize the available analyte molecules for the acquisition of individual time-of-flight spectra. For today's preparations of thin tissue sections for ionization by matrix-assisted laser desorption (MALDI), a layer of tiny crystals of matrix material is applied to the thin section, and the soluble peptides and proteins from the thin section are transported into the top layer of the crystals. With these thin layer preparations, the analyte molecules under the laser spots are exhausted after three to five laser shots if the spot pattern is not moved. Here also, position-controlled laser spot guidance helps to ablate different, still unused sites every time. Up to now, however, an additional movement of the sample support plate has been required in order to achieve a really uniform ablation of a given sample surface. But a really uniform movement of the sample support is almost impossible to achieve because of the oscillations.

In view of the above there is a need to facilitate the grid-like acquisition of mass spectra over a relatively large area, for example an area of half to one square millimeter, while the sample support is at rest, for the purpose of analyzing samples with high spatial density, such as tissue samples for imaging mass spectrometry. This makes it possible to move the sample support at longer intervals of time and to allow a period of time for oscillations of the sample support to settle without large losses in efficiency.

SUMMARY OF THE INVENTION

In view of this introduction, the present disclosure relates to a method to operate a time-of-flight mass spectrometer, comprising the steps:—pulsed ionization of a sample deposited on a sample support in an ion source using a desorption beam, e.g. a laser beam (for MALDI in particular) or a primary ion beam (for SIMS in particular), where the desorption beam is deflected from an axis of the ion source for part of the time in order to sweep a sample surface, and—acceleration of ions onto a flight path by means of diaphragms which act as ion-optical lenses, where at least one of the diaphragms is subdivided into a plurality of segments (e.g. halves, quadrants, or octants) and the segments are supplied with asymmetrical voltages (in particular all segments, or at least some of them, with an individual voltage), harmonized with the deflection of the desorption beam, such that ions which are produced in a desorption beam spot off axis are accelerated in phase into an ion beam by a lens center off the axis, which acts in the diaphragm, said ion beam running parallel to the axis.

The aforementioned objective is thus particularly solved by placing a puller lens arrangement in front of the sample support, where at least one of the lens diaphragms is subdivided into segments, for example halves, quadrants or octants, and a voltage supply is able to supply the segments, or at least some of them, with different voltages. It is then possible to virtually shift the effective focusing center of the lens away from the axis; and an ion beam generated off the real lens axis, depending on the deflection of the desorption beam, can be focused, with no time phase shift for ions of the same mass, into a beam which essentially runs parallel to the real lens axis.

When the focusing center is strongly deflected, the equipotential lines around the center assume a slightly oval shape. This leads to a situation where different focusing forces prevail in two mutually perpendicular directions and it is a challenge to create a completely homogeneous ion beam. A practically circular focusing center can be produced if, for example, the lens diaphragm is divided up into octants with eight separately controllable voltage supplies. In simple embodiments, it appears conceivable in addition to subdivide the diaphragm into three segments (each covering around 120°) or a larger odd number of segments, albeit that this asymmetric design is not preferred because the resulting calculation of the deflection voltages for shifting the lens center is complicated. It is furthermore conceivable to subdivide a diaphragm into segments, e.g. octants, of which only a subset, e.g. four segments out of eight, are supplied with an individually adjustable voltage as a function of the deflection of the desorption beam.

In various embodiments, the ion beam can be brought back onto the axis using an x-y deflection unit with adjustable voltage supplies downstream of the ion source, harmonized with the deflection of the desorption beam. This is suitable for reflector time-of-flight mass spectrometers, in particular, where the point of incidence and the angle of incidence of the ion beam into the reflector can influence the reflection behavior.

In various embodiments, a potential of the sample support can be adjusted via an adjustable voltage supply, harmonized with the deflection of the desorption beam. Since the virtual lens does not have the same focal length off the axis, and does not provide the same acceleration profile for the ions because the potential well is of a different depth, it may also be necessary to vary the voltage on the sample support (and/or another acceleration voltage and/or other parts of the flight tube in which the flight path lies) in order to generate time-of-flight spectra with the same dependence of the ion masses on the times of flight.

It is possible and conceivable to deflect the desorption beam spot more than 50 micrometers, in particular up to 250, 300 or even 500 micrometers, from the axis of the ion source (and to virtually track the focusing center of the diaphragm by appropriate adjustment of the individual voltages). When the inner apertures of the acceleration diaphragms are three to five millimeters in diameter, the effective focusing center can also be shifted by around half a millimeter.

In various embodiments, a computing unit can control the deflection of the desorption beam and set the potentials on the segments of the diaphragm(s), on the sample support and/or on the x-y deflection unit (and on other parts of the flight tube also, where necessary). It is most preferable when a program in the computing unit automatically calibrates the adjustable voltages as a function of a position of the desorption beam spot. These types of time-of-flight mass spectrometer have a computing unit which controls the desorption beam via programs. These programs can also control the voltages on the diaphragm segments, the correcting voltage on the sample support, the voltages on the x-y deflection unit (if present) and/or on other parts of the flight tube via suitable digital-to-analog converters (DACs).

The present disclosure likewise relates to a time-of-flight mass spectrometer with an ion source for pulsed ionization of a sample deposited on a sample support using a desorption beam, where the ion source has diaphragms which act as ion-optical lenses to accelerate the ions onto a flight path and a positional control to deflect the desorption beam from the axis of the ion source. It is characterized by at least one of the diaphragms being sub-divided into a plurality of segments and independently adjustable voltage supplies for at least some of the segments of the diaphragm so that asymmetrical voltages on the corresponding segments generate an effective lens center off the axis for ions which are produced in a desorption beam spot off the axis. This lens center accelerates the ions in phase into an ion beam which runs parallel to the axis of the ion source. It shall be understood that the embodiments explained above in connection with the method can also be applied to the time-of-flight mass spectrometer as a device.

BRIEF DESCRIPTION OF THE DRAWINGS

The invention can be better understood by referring to the following illustrations. The elements in the illustrations are not necessarily to scale, but are primarily intended to illustrate the principles of the invention (largely schematically).

DETAILED DESCRIPTION

While the invention has been illustrated and explained with reference to a number of embodiments, those skilled in the art will recognize that various changes in form and detail may be made to it without departing from the scope of the technical teaching defined in the attached claims.

Figure 1:
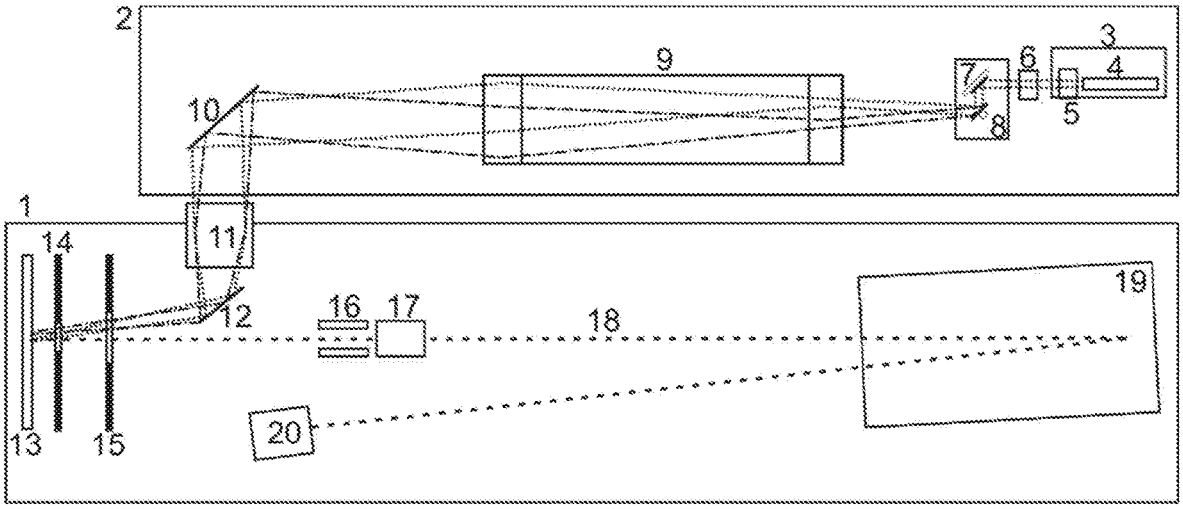
FIGURE 1 (PRIOR ART)
FIG. 1 is a schematic of a MALDI time-of-flight mass spectrometer according to the Prior Art with a time-of-flight analyzer (1) and a laser system (2) which controls the laser spot position of the light pulse on the sample support (13) by means of a mirror system (7, 8). The laser pulse is generated in the beam generation unit (3), which contains a laser crystal (4) and, if required, a device (5) for frequency multiplication, is separated into a spot pattern in the pattern generator (6), and deflected in both spatial directions in the mirror system by two galvo mirrors (7) and (8). The deflected laser beam is then expanded in a Kepler telescope (9) and shifted in parallel according to the angular deflection. The exiting laser beam is then directed into the objective lens (11) with reduced angular deflection via the mirror (10) so as to be perfectly central. Depending on the angular deflection, the beam passes through the objective lens (11) centrally, but at slightly different angles, thus shifting the position of the spot pattern on the sample support plate (13). The ions generated in the plasma clouds of the laser spot pattern are accelerated by voltages on the diaphragms (14) and (15) to form an ion beam (18), which passes through the two deflection capacitors (16) and (17) to correct its trajectory and is focused in the reflector (19) onto the detector (20). It should be noted here that the beam guidance within a Kepler telescope (9) is more complex and the illustration does not reproduce it in real terms for reasons of simplicity, although the illustration does correctly reproduce the effect of the telescope on the laser light beam as seen from the outside.
Figure 2:
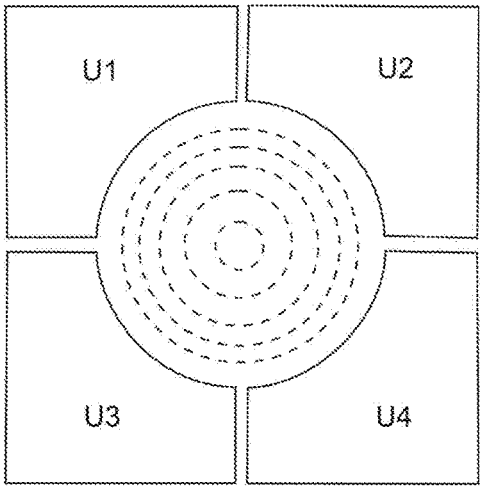
FIGS. 2 and 3 depict equipotential lines in an ion-optical lens, which is composed of quadrants in the example shown. If all four quadrants are supplied with the same voltage U1=U2=U3=U4, the equipotential lines are circular and the effective focusing center is in the middle (FIG. 2). If the voltages are applied asymmetrically, for example U1=U2≠U3=U4, i.e. in this example with paired configuration, although completely asymmetrical voltages are also conceivable (U1≠U2≠U3≠U4) depending on the situation, the potential minimum shifts and thus the effective focusing center of the lens shifts a small distance outward from the middle (FIG. 3). The focusing power and the depth of the potential well also change here, but they can be compensated for by using slightly different acceleration voltages for the ions on the sample support (or if applicable on other diaphragm electrodes on the flight path or the flight tube itself).

The invention is inspired by fast laser spot control, as it is shown in FIG. 1. FIG. 1 is a schematic of a MALDI time-of-flight mass spectrometer according to patent specification DE 10 2011 112 649 B4 with a time-of-flight analyzer (1) and a laser system (2) which controls the laser spot position of the light pulse on the sample support plate (13) in the mass spectrometer by means of two steerable rotating mirrors (7, 8) in the laser system. The laser pulse is generated in the beam generation unit (3), which contains a laser crystal (4) and, if required, a device (5) for frequency multiplication, separated into a spot pattern in the pattern generator (6), and deflected in both spatial directions by two galvanometer mirrors (7) and (8). The deflected laser beam is then expanded in a Kepler telescope (9) and shifted in parallel according to the angular deflection. The exiting laser beam is then directed into the objective lens (11) with reduced angular deflection via the mirror (10) so as to be perfectly central. Depending on the angular deflection, the beam passes through the objective lens (11) centrally, but at slightly different angles, thus shifting the position of the spot pattern on the sample support plate (13). The ions generated in the plasma clouds of the laser spot pattern are accelerated by voltages on the diaphragms (14) and (15) to form an ion beam (18), which passes through the two deflection capacitors (16) and (17) to correct its trajectory and is focused in the reflector (19) onto the detector (20). It should be noted here that the beam guidance within a Kepler telescope (9) is more complex and the illustration does not reproduce it in real terms for reasons of simplicity, although the illustration does correctly reproduce the effect of the telescope on the laser light beam as seen from the outside.

It should be pointed out furthermore that linear operation of the time-of-flight analyzer (1) is conceivable without using the reflector (19). In this case, a detector would be positioned immediately opposite the support plate (13), without any ion beam reflection. Deflection capacitors can be dispensable in such a set-up.

Depending on the embodiment, the spot control can produce a deflection of the laser spot by plus/minus 300, 400 or even 500 micrometers from the center without significant distortion of the spot area. As yet, however, it has not been possible to exploit the wide deflection without negative consequences for the mass resolution, since the puller lens (14) distorts the ion beam off the center to such an extent that ions of the same mass no longer lie in a front perpendicular to the beam direction of the ions. This means that it is no longer possible to maintain the high mass resolution of an ion beam generated at the center. The deflection of a desorption beam which can be used at high mass resolution without any discernible deterioration in the mass resolution is around plus/minus 50 micrometers.

If the sample support plate is to be at rest during the operation, it is only possible to scan a measurement spot of 100 micrometers by 100 micrometers in each case with current technology. To obtain the mass spectrometric image of only one square millimeter, 100 movements of the sample support plate are necessary with the appropriate settling times. This does not even guarantee that the individual measurement spots accurately abut, because the accuracy of movement of the sample support plate is restricted to around one to four micrometers. A tissue area of one square centimeter requires 10,000 movements of the sample support.

As has already been explained above, the objective of the invention is to facilitate the scanning of a relatively large surface area on a stationary sample support for the analysis of tissue samples for imaging mass spectrometry, but also for high-throughput analyses with thousands of tiny, separate samples on a sample support plate. The surface area can be, for example, 1,000 micrometers by 1,000 micrometers, i.e. approximately one square millimeter. The deflection of the desorption beam from the center axis would then be plus/minus 500 micrometers. This makes it possible to move the sample support plate only at longer time intervals and to allow a period of time for the oscillations of the sample support plate to settle, without losing a lot of time. Only 100 movements would then be necessary for one square centimeter of tissue, instead of the 10,000 according to the prior art. The time for the oscillations to settle could quite easily be around half a second; the acquisition time for one square centimeter of tissue area would then be extended by only 50 seconds, so less than one minute.

Figure 7:
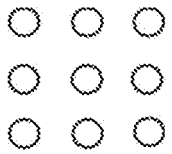
FIG. 7 shows the pattern of a laser spot with nine individual intensity peaks for MALDI ionization. This pattern is particularly advantageous because it combines high sensitivity with low sample consumption. The individual peaks each have a diameter of around five micrometers; the separations between the peaks each amount to five micrometers, also.

The time it takes to acquire the mass spectra of a tissue area of one square centimeter depends on the pixel size selected, the pattern or contour of the desorption beam, and the number of shots on each sample site. If, for example, a laser spot pattern like the one shown in FIG. 7 is chosen, and a pixel size of 60 by 60 square micrometers, then one square centimeter of tissue area contains nearly 28,000 pixels. If every pixel is sampled with 32 laser shots, this results in a total acquisition time of around 90 seconds at 10,000 spectral acquisitions per second. Added to this is the settling time of 50 seconds. If four overlapping scans are acquired on the same site to exhaust the sample, this results in a total time of around seven minutes.

Figure 4:
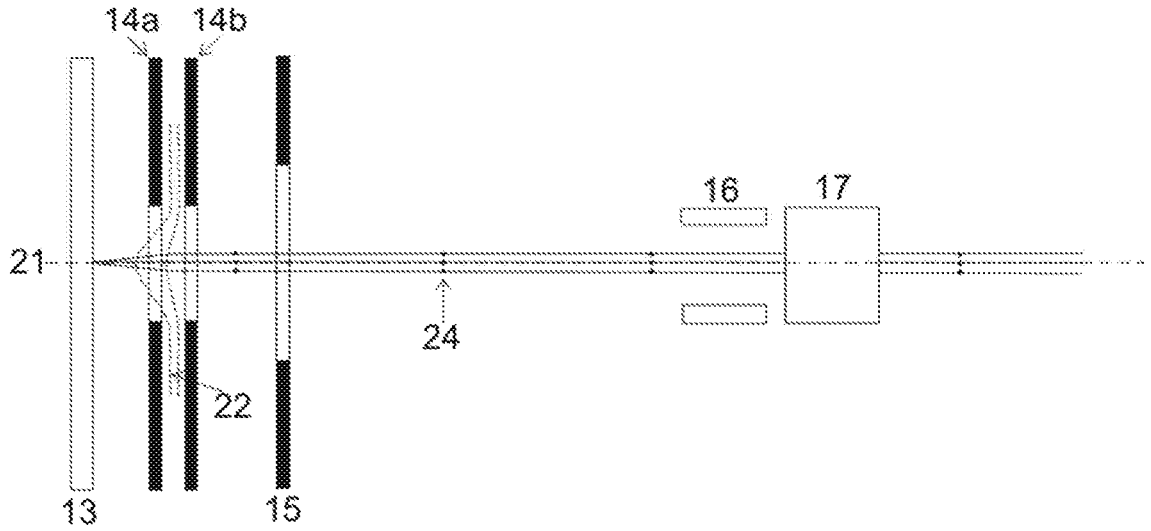
FIG. 4 depicts an enlargement of the ion source of the arrangement according to FIG. 1, but here the puller lens (14) from FIG. 1 is subdivided into two lens diaphragms (14*a*) and (14*b*), and the sections of two equipotential surfaces (22) have been added to illustrate the function of the lens. The voltages are applied to the lens diaphragms in such a way that the equipotential surfaces (22) form a penetration of the potential through the diaphragm (14*a*) and thus form an ion lens. The desorption beam (not shown) produces ions on the axis (21) of the arrangement here; the slightly diverging ion beam is formed into a parallel beam by the lens. Ions of the same mass (24) form a front which lies perpendicular to the beam axis.
Figure 5:
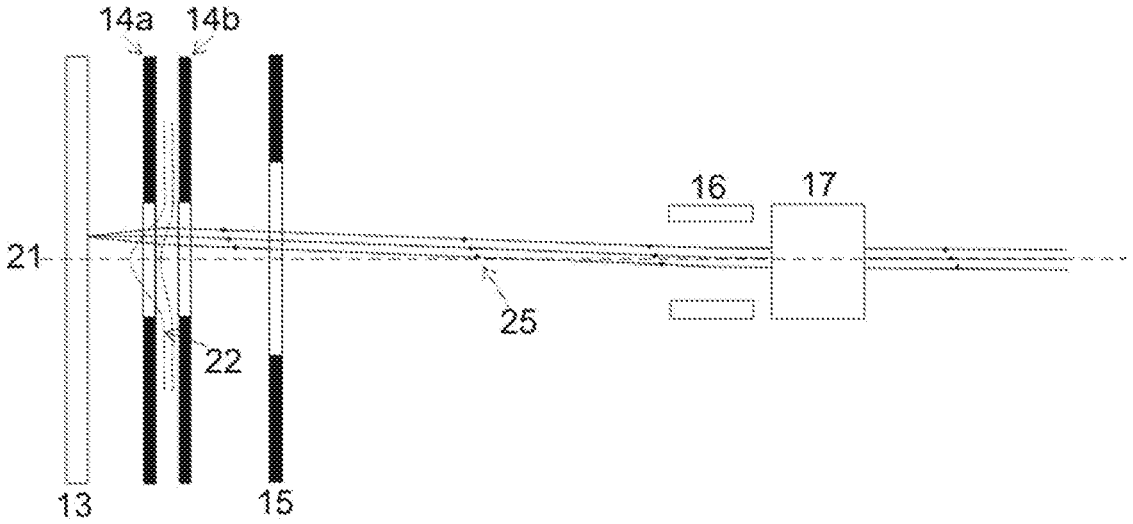
In FIG. 5, the desorption beam (not shown) generates the ions off-axis (21) of the arrangement. The lens (14*a*, 14*b*) again produces a parallel beam, which is inclined with respect to the axis, however, and is steered back onto the axis by the deflection unit (16, 17). In this case, the ions (25) of the same mass no longer form a front which is perpendicular to the beam axis of the ions, however. This means they do not arrive at the ion detector simultaneously; the resolution is reduced.
Figure 6:
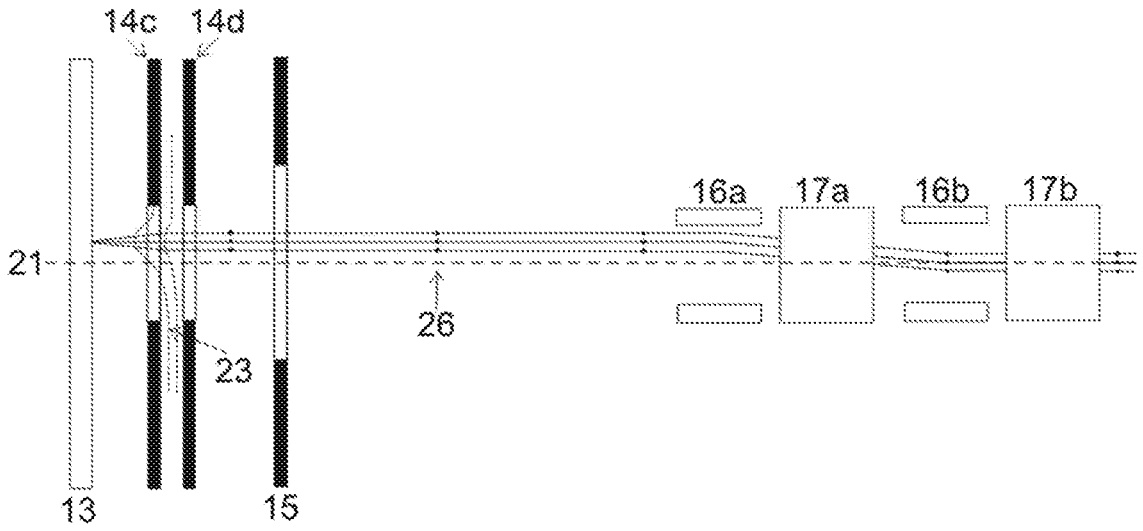
FIG. 6 depicts the lens diaphragm (14*c*) as a quadrant diaphragm for illustration purposes, as it can be seen in FIG. 3. The voltages are applied to the lens in such a way that the equipotential surfaces (23) form an effective focusing center (a focusing potential well of the penetration) off the beam axis and form the slightly diverging ions, which in turn are created outside the axis (21) of the arrangement, into a parallel beam. This beam now runs parallel to the axis (21) and can be returned to the axis (21) by a doubled deflection unit (16*a*, 17*a*, 16*b*, 17*b*), for example to facilitate optimum entry into a reflector. By shifting the focusing center of the lens, the ions (26) of equal mass are made to fly in a front again which is perpendicular to the axis of the ion beam. The ions of the same mass therefore arrive at the detector simultaneously; the resolution is maintained despite the deflection of the desorption beam to sweep the sample surface.

If the ions are produced off the axis of the ion source and focused off-axis by a virtual ion-optical lens center, as depicted in FIG. 6, the ions do not pass through exactly the same acceleration profile as the ions close to the axis in FIG. 4. The ions (24) in FIG. 4 therefore have a slightly different energy to the ions (26) in FIG. 6. The length of the flight path can also change with increasing deflection of the desorption beam, especially when deflection units are used. Ions located off the axis thus have a slightly different time of flight than the ions of the same mass on the axis. By slightly modifying the potential on the sample support plate (and also on other diaphragm electrodes on the flight path or parts of the flight tube itself, where necessary), ions of the same mass but different spatial origin can be given a uniform time of flight. Overall, when the desorption beam is shifted, not only the voltages on the lens segments, but also the potential of the sample support plate and the deflection voltages on the deflection units (16*a*), (17*a*), (16*b*) and (17*b*) (and also on other parts of the flight tube, where necessary) must track this shift in order to add together different individual spectra acquired with varying desorption beam deflection to form a sum spectrum.

Figure 3:
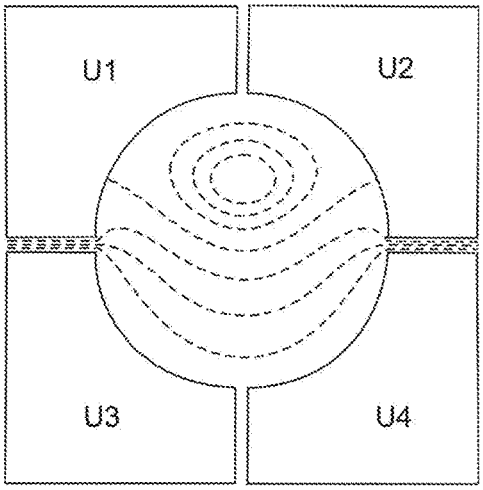

When the focusing center is strongly deflected away from the axis, the equipotential lines around the center assume a slightly oval shape, as is shown in FIG. 3 by way of example. This leads to a situation where different focusing forces prevail in two mutually perpendicular directions and it is not possible to create a completely homogeneous ion beam with ions flying in parallel. A practically circular focusing center can be produced, for example, if the lens diaphragm is divided up into octants with eight voltage supplies which can be controlled separately (not shown).

In view of the paired configuration of four segments illustrated in FIG. 3, it is also conceivable to subdivide a diaphragm into only two halves (not shown). The effective ion-optical lens center of such a diaphragm could then only be shifted along an axis which runs perpendicular to the dividing line between the two halves. However, since deflections of the desorption beam spot on the sample support of up to +/−50 micrometers do not cause a discernible deterioration in the mass resolution, even without tracking the effective ion-optical lens center, it is nevertheless possible, according to one embodiment, to sweep an elongated area on the sample with the desorption beam, for example, where in particular the minor axis is within the said maximum +/−50 micrometers, and the major axis moves within a maximum deflection which can still be compensated by shifting the center (approximately up to +/−500 micrometers), thus for example covering a rectangle with a maximum edge length of 100 micrometers×1,000 micrometers.

Control of the changes of all these voltages with the movement of the desorption beam should be recalibrated at least once, but better repeatedly at selected time intervals. Fast positional control can be used here for the automated, program-controlled determination of the optimal voltages for every position of the desorption beam spot. The optimal voltages are defined by the highest sensitivity of the mass spectrometer and highest mass resolution thus achieved. Special samples which provide time-of-flight spectra of uniform intensity over many hours and millions of desorption beam shots can be used for this purpose. Such samples are known, for example liquid applications of peptides dissolved in glycerol can be used here. With these glycerol samples, fresh analyte molecules continually diffuse through the liquid to the site under the particular desorption beam spot to replenish the supply. With this method, the correlation between all correction voltages for diaphragm segments, beam deflections, additional accelerations, and flight tube potentials, on the one hand, and the impact position of the desorption beam, on the other hand, can be determined fully automatically with this method.

Figure 8:
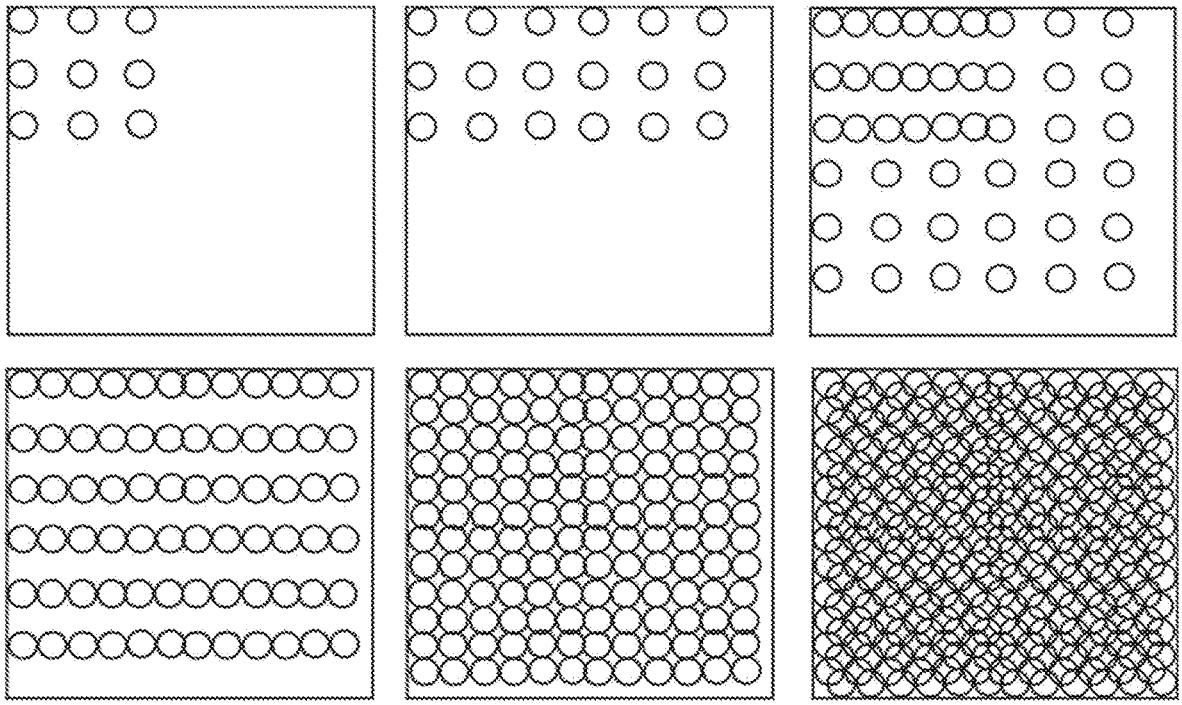
FIG. 8 illustrates how a pixel measuring 60 by 60 micrometers square is sampled precisely once with the pattern of FIG. 7 using MALDI ionization in 32 laser shots (square at the bottom right). As a rule, around four to five samplings can be carried out on thin section matrix coatings before the sample is exhausted and therefore a sum spectrum of around 120 to 150 individual spectra can be obtained from this pixel.

Frequent use has been made here of the term "pixel", from which a mass spectrum is taken. This term requires slightly more detailed consideration and explanation. A pixel is not one point of the sample, but an area of a selected size, for example 10 by 10 micrometers square, or 60 by 60 micrometers square. With MALDI ionization in particular, it is not advantageous, for the acquisition of the individual time-of-flight spectra of a sample, to use a laser spot or a laser spot pattern always at precisely the same site, since the sample is exhausted very quickly here. For thin layer preparations, it is exhausted after around three to five laser shots. It is therefore expedient to scan the available area of the pixel such that the sample is ablated uniformly. Where possible, even the individual laser spots in sequential laser shots should not be set in a closely packed pattern, since this could cause excessive local heating of the sample material. A scanning pattern should therefore be selected which, if possible, avoids local overheating of the sample material and also ensures that the sample is ablated uniformly across the available pixel area. FIG. 8 depicts, by way of example, a scanning pattern for such a uniform ablation with the aid of a laser spot pattern with 9 intensity peaks where in a sample area square of precisely 60 micrometers edge length, a layer of the sample is ablated quite uniformly with a total of 32 laser shots. This scanning is facilitated by the fast positional control for the laser spot or laser spot pattern and can be applied to other types of desorption beam also.

It is also possible to scan finer squares, but it is then unavoidable that the laser spots are placed very closely together. With the pattern of nine intensity peaks, it is thus possible to scan a square of 30 micrometers edge length in eight laser shots. If the yield of the sample allows five ablation layers to be ablated, 40 individual time-of-flight spectra can be added together in each case to form a sum time-of-flight spectrum of this finer sample area. Squares with 18-micrometer edge length can be scanned with spot patterns with only four intensity peaks. The ablation of finer squares increases the spatial resolution of the tissue image, albeit to the detriment of the detection limit and the signal-to-noise ratio; but in many cases, finer pixels can subsequently be combined to larger pixel areas, unless different mass spectra from very fine tissue structures unexpectedly appear in the finer areas.

In the extreme case, this method can be used with intensity peaks of five-micrometer diameter, for example, and five laser shots per site to measure a surface with maximum resolution so that the mass spectra can also show even the finest of structures. If no fine structures are evident here, the data processing can subsequently combine groups of these mass spectra again into pixels with lower spatial resolution in order to achieve a better signal-to-noise ratio. This makes it possible to retrospectively obtain weak signals with low resolution and strong signals with high resolution from the data.

Methods for optimal preparation of the samples and optimal acquisition and processing of mass spectra for various analytical tasks are known to the person skilled in the art and do not need to be described in detail here. For imaging mass spectrometry on thin tissue sections, for example, sample preparations on special specimen slides with electrically conductive surfaces and with application of the layers of fine crystals of the matrix material are individually explained in the documents DE 10 2006 019 530 B4 (M. Schürenberg et al.) and DE 10 2006 059 695 B3 (M. Schürenberg). The document DE 10 2010 051 810 (D. Suckau et al.) describes how a local digest of proteins to produce digest peptides can be carried out and used to identify the proteins of the thin tissue section. The document DE 10 2008 023 438 A1 (S.-O. Deininger et al.) explains how a high resolution visual image is overlaid with the mass spectrometric image. Document DE 10 2010 009 853 A1 (F. Alexandrov) illustrates how mathematical processing can be used to generate a largely noise-free image of proteins on the tissue section.

The invention has been described above with reference to different, specific example embodiments. It is to be understood, however, that various aspects or details of the embodiments described can be modified without deviating from the scope of the invention. In particular, the arrangement of the lens diaphragms with their quadrants stated here is not the only possible arrangement for the production of parallel ion beams with ions of the same phase from desorption beam spots which are not on the axis of the lens arrangements. Apart from MALDI, other pulsed types of ionization such as SIMS can be used also. The invention should therefore not be restricted to these arrangements. Furthermore, features and measures disclosed in connection with different embodiments can be combined as desired if this appears feasible to a person skilled in the art. Moreover, the above description serves only as an illustration of the invention and not as a limitation of the scope of protection, which is exclusively defined by the appended Claims, taking into account any equivalents which may possibly exist.

The invention claimed is:

1. A method for the operation of a time-of-flight mass spectrometer, comprising the steps:

pulsed ionization of a sample deposited on a sample support in an ion source using a desorption beam, where the desorption beam is deflected from an axis of the ion source for part of the time in order to sweep a sample surface, and acceleration of ions onto a flight path using diaphragms which act as ion-optical lenses, where at least one of the diaphragms is subdivided into a plurality of segments and the segments are supplied with asymmetrical voltages, harmonized with the deflection of the desorption beam, such that ions which are produced in a desorption beam spot off the axis are accelerated in phase into an ion beam by a lens center off the axis, which acts in said at least one diaphragm, said ion beam running parallel to the axis.

2. The method according to claim 1, wherein said at least one diaphragm is subdivided into halves, quadrants or octants, of which all or at least some are individually supplied with a voltage, harmonized with the deflection of the desorption beam.

3. The method according to claim 1, wherein a laser beam or primary ion beam (SIMS) is used as the desorption beam.

4. The method according to claim 3, wherein the ion source operates with ionization by matrix-assisted laser desorption (MALDI).

5. The method according to claim 1, wherein the ion beam is brought back onto the axis by means of an x-y deflection unit with adjustable voltage supplies downstream of the ion source, harmonized with the deflection of the desorption beam.

6. The method according to claim 1, wherein a potential of the sample support, a potential of a further acceleration diaphragm and/or a potential on the flight tube in which the flight path runs, is adapted via appropriately adjustable voltage supplies, harmonized with the deflection of the desorption beam.

7. The method according to claim 1, wherein the desorption beam spot is deflected more than 50 micrometers away from the axis of the ion source.

8. The method according to claim 5, wherein a computing unit controls the deflection of the desorption beam and sets the potentials on the segments of the diaphragm(s), on the sample support and/or on the x-y deflection unit.

9. The method according to claim 8, wherein a program in the computing unit automatically calibrates voltages of the adjustable voltage supplies as a function of a position of the desorption beam spot.

10. A time-of-flight mass spectrometer with an ion source for pulsed ionization of a sample deposited on a sample support using a desorption beam, where the ion source has diaphragms which act as ion-optical lenses to accelerate the ions onto a flight path and a positional control to deflect the desorption beam from the axis of the ion source, wherein at least one of the diaphragms is subdivided into a plurality of segments and independently adjustable voltage supplies for at least some of the segments of said at least one diaphragm are provided so that asymmetrical voltages on the corresponding segments generate an effective lens center off the axis for ions which are produced in a desorption beam spot off the axis, and said lens center accelerates the ions in phase into an ion beam which runs parallel to the axis.

* * * * *